US010612234B2

(12) United States Patent
Wright et al.

(10) Patent No.: US 10,612,234 B2
(45) Date of Patent: Apr. 7, 2020

(54) DRY STACK CONSTRUCTION BLOCK SYSTEM AND METHOD

(71) Applicants: Malcolm John Paul Wright, Orlando, FL (US); Bettina Ingrid Brieke, Orlando, FL (US); Brieke Family Assets Ltd., Ewshot (GB)

(72) Inventors: Malcolm John Paul Wright, Orlando, FL (US); Bettina Ingrid Brieke, Orlando, FL (US); Malcolm John Wright, Orlando, FL (US)

(73) Assignees: Malcolm John Paul Wright, Orlando, FL (US); Bettina Ingrid Brieke, Orlando, FL (US); Brieke Family Assets Ltd., Ewshot (GB)

( * ) Notice: Subject to any disclaimer, the term of this patent is extended or adjusted under 35 U.S.C. 154(b) by 0 days.

(21) Appl. No.: 16/043,203

(22) Filed: Jul. 24, 2018

(65) Prior Publication Data

US 2019/0177972 A1 Jun. 13, 2019

Related U.S. Application Data

(60) Provisional application No. 62/595,691, filed on Dec. 7, 2017.

(51) Int. Cl.
*E04B 2/18* (2006.01)
*E04B 2/26* (2006.01)
(Continued)

(52) U.S. Cl.
CPC ..... *E04B 2/18* (2013.01); *E04B 2/22* (2013.01); *E04B 2/26* (2013.01); *E04B 2/52* (2013.01);
(Continued)

(58) Field of Classification Search
CPC ..... E04B 2/18; E04B 2/22; E04B 2/26; E04B 2002/0254; E04B 2/42; E04B 2/52; E04B 2/54
See application file for complete search history.

(56) References Cited

U.S. PATENT DOCUMENTS 4,123,881 A * 11/1978 Muse ..... E04B 2/44 52/100
4,748,782 A 6/1988 Johnson et al.
(Continued)

FOREIGN PATENT DOCUMENTS

DE 3418007 A1 * 11/1985 ..... E04B 1/7604
WO WO-2009076646 A1 * 6/2009 ..... E04B 2/40

*Primary Examiner* — Adriana Figueroa

(57) ABSTRACT

A dry stack block structure, comprising: at least one course comprising blocks, each comprising: a first and second side walls and a central wall positioned between and parallel to the side walls, wherein the walls are rectangular and having a bottom and top edges located in a first plane and a parallel second plane, a first end and a second end located in a third plane and a parallel fourth plane, perpendicular to the first plane; a first and second end transverse webs connecting the ends respectively of the walls in the third and fourth planes respectively, wherein the end transverse webs having a bottom edge located in the first plane; and two intermediate transverse webs positioned between the third and fourth planes and connecting the second and central walls, the intermediate transverse webs having a bottom edge and a top edge located in the first and second planes.

14 Claims, 10 Drawing Sheets

(51) Int. Cl.

| | |
|---|---|
| ***E04B 2/22*** | (2006.01) |
| ***E04B 2/52*** | (2006.01) |
| ***E04B 2/54*** | (2006.01) |
| *E04B 2/02* | (2006.01) |

(52) U.S. Cl.
CPC ..... *E04B 2/54* (2013.01); *E04B 2002/0254* (2013.01)

(56) References Cited

U.S. PATENT DOCUMENTS

| | | | | |
|---|---|---|---|---|
| 4,769,964 | A | 9/1988 | Johnson et al. | |
| 6,513,293 | B2 * | 2/2003 | Miller | E04C 1/397 52/309.12 |
| 7,934,351 | B2 * | 5/2011 | Clarno | E04C 1/395 405/262 |
| 8,091,308 | B2 | 1/2012 | Westmoreland et al. | |
| 2009/0025333 | A1 * | 1/2009 | Moroschan | E04B 2/26 52/742.13 |

* cited by examiner

DRY STACK CONSTRUCTION BLOCK SYSTEM AND METHOD

RELATED APPLICATIONS

This application claims the benefit of priority under 35 USC § 119(e) of U.S. Provisional Patent Application No. 62/595,691 filed on Dec. 7, 2017, the contents of which are incorporated by reference as if fully set forth herein in their entirety.

FIELD AND BACKGROUND OF THE INVENTION

The present invention relates to dry stack construction blocks, and more particularly, but not exclusively, to dry stack construction blocks, and to systems and methods for dry stack block wall construction.

Masonry blocks used in the construction industry may be typically constructed of various materials, e.g., lightweight concrete being the most prevalent. Various designs of blocks have also been utilized, many attempting to minimize the weight of the block while preserving as much structural strength as possible. A typical block design includes exterior walls connected by webs of various designs, creating interior cores of air space, which results in reducing weight of the block. In addition, the air space provides for decreasing overall thermal conductivity of the block.

Typical masonry block wall construction included mortar joints between blocks of each course and between successive courses of blocks, requiring skilled labor to erect the wall. The mortar joints provide for leveling and maintaining uniform dimensions for each course of block albeit variations in dimensions of individual blocks.

Masonry block construction without use of mortar between adjacent blocks is typically also referred to as dry stack block construction. Some advantages of the dry stack block construction in comparison to mortared block wall construction include, for example, increased construction speed, decreased labor costs and simple skill level required for mere stacking of blocks along a desired wall alignment. Further, a tray for holding of bricks and/or of mortar ("hod tenders") is not required. Structural strength of a block wall is provided by, e.g., horizontal bond beams and/or vertical grout columns, each with one or more reinforcing bars ("rebar") grouted in place.

SUMMARY OF THE INVENTION

According to an aspect of some embodiments of the present invention there is provided a dry stack block structure, comprising: at least one course comprising a plurality of middle blocks, each of the middle blocks comprising: a first side wall, a second side wall and a central wall positioned between and parallel to the first side wall and the second side wall, wherein the first, second and central walls are rectangular and having a bottom edge located in a first plane, a top edge located in a second plane which is parallel to the first plane, a first end located in a third plane which is perpendicular to the first plane, and a second end located in a fourth plane which is parallel to the third plane; a first and second end transverse webs connecting the first ends and the second ends respectively of the first side wall and the central wall in the third and fourth planes respectively, wherein the first and second end transverse webs having a bottom edge located in the first plane; and a first and second intermediate transverse webs positioned between the third plane and the fourth plane and connecting the second side wall and the central wall, the intermediate transverse webs having a bottom edge located in the first plane and a top edge located in the second plane.

Optionally, the dry stack block structure further comprises a course comprising a plurality of U blocks and positioned on top of the at least one course of middle blocks, each of the U blocks comprising: a first U block side wall and a second U block side wall, wherein the first and second U block side walls are rectangular and having a bottom U block edge located in a first U block plane, a top U block edge located in a second U block plane which is parallel to the first U block plane, a first U block end located in a third U block plane which is perpendicular to the first U block plane, and a second U block end located in a fourth U block plane which is parallel to the third U block plane; a first and second U block end transverse webs connecting the first U block ends and the second U block ends respectively of the first U block side wall and the second U block wall in the third and fourth U block planes respectively; and a middle U block transverse web positioned between the a first and second U block end transverse webs and connecting the first U block side wall and the second U block side wall; wherein the first U block end, second U block end and middle U block transverse webs are U-shaped and having a bottom U block edge located in the first U block plane.

More optionally, the dry stack block structure further comprises at least one reinforcing rebar extending horizontally through the transverse webs of the plurality of U blocks, the reinforcing rebars being grouted in place in the plurality of U blocks, thereby forming a grout beam.

Optionally, the dry stack block structure further comprises a plurality of vertical reinforcing rebars extending through vertically aligned cells of the a plurality of middle blocks, the reinforcing rebars being grouted in place in the vertically aligned cells, thereby forming a plurality of grout columns.

More optionally, the dry stack block structure further comprises a foundation, wherein the plurality of vertical reinforcing rebars are anchored to the foundation.

Optionally, the dry stack block structure further comprises a plurality of reinforcing rebars extending through horizontally aligned cells of the a plurality of middle blocks, the reinforcing rebars being grouted in place in the horizontally aligned cells, thereby forming a plurality of grout beams.

Optionally, the dry stack block structure further comprises a surface bonding material applied on the first side wall and the second side wall.

According to an aspect of some embodiments of the present invention there is provided a method for erecting a dry stacked block wall, comprising: stacking a plurality of dry stack middle blocks into at least two courses, each of the dry stack middle blocks comprising: a first side wall, a second side wall and a central wall positioned between and parallel to the first side wall and the second side wall, wherein the first, second and central walls are rectangular and having a bottom edge located in a first plane, a top edge located in a second plane which is parallel to the first plane, a first end located in a third plane which is perpendicular to the first plane, and a second end located in a fourth plane which is parallel to the third plane; a first and second end transverse webs connecting the first ends and the second ends respectively of the first side wall and the central wall in the third and fourth planes respectively, wherein the first and second end transverse webs having a bottom edge located in the first plane; and a first and second intermediate transverse webs positioned between the third plane and the fourth plane and connecting the second side wall and the central wall, the intermediate transverse webs having a bottom edge located in the first plane and a top edge located in the second plane; installing at least one vertical rebar through selected cells of the plurality of dry stack middle blocks; for each of the at least two courses, filling the selected cells with grout; for each of the at least two courses, injecting closed cell foam into all other non-selected cells of the plurality of dry stack middle blocks; stacking a plurality of dry stack U blocks into one course on top of the at least two courses, each of the dry stack U blocks comprising: a first U block side wall and a second U block side wall, wherein the first and second U block side walls are rectangular and having a bottom U block edge located in a first U block plane, a top U block edge located in a second U block plane which is parallel to the first U block plane, a first U block end located in a third U block plane which is perpendicular to the first U block plane, and a second U block end located in a fourth U block plane which is parallel to the third U block plane; a first and second U block end transverse webs connecting the first U block ends and the second U block ends respectively of the first U block side wall and the second U block wall in the third and fourth U block planes respectively; and a middle U block transverse web positioned between the a first and second U block end transverse webs and connecting the first U block side wall and the second U block side wall; and wherein the first U block end, second U block end and middle U block transverse webs are U-shaped and having a bottom U block edge located in the first U block plane; installing at least one horizontal rebar through the plurality of dry stack U blocks; and filling the one course of the dry stack U blocks with grout to create a horizontal bonding beam.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1A:
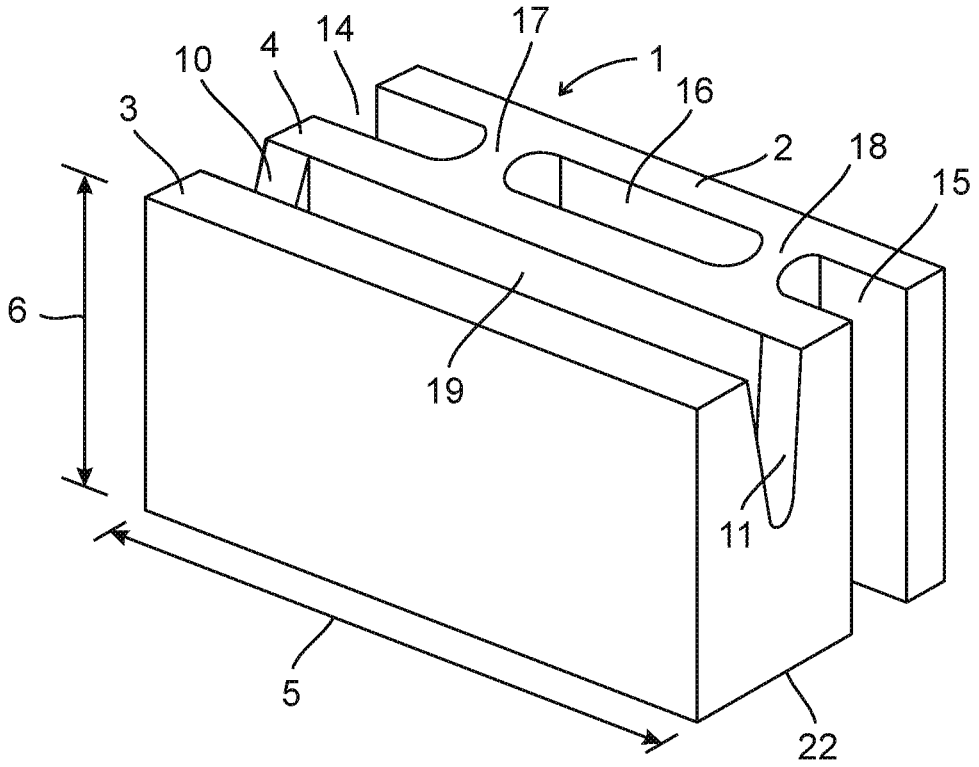
FIGS. 1A and 1B are top and bottom perspective views of an exemplary dry stack construction block, respectively, according to some embodiments of the present invention.

The present invention relates to dry stack construction blocks, and more particularly, but not exclusively, to dry stack construction blocks, and to systems and methods for dry stack block wall construction.

Some of the previously presented dry stack construction blocks include three parallel block walls which are connected by notched webs perpendicular to the block walls, creating cells within the block. The notches in the web are used for placing horizontal rebars inside the blocks and used for holding specially made foam inserts. These types of blocks were found to easily break at the notched webs when handling. Another problem with some of the previously presented dry stack construction blocks is that the foam inserts are costly to produce, costly to transport after manufacture to the building site, and do not fit snugly into the block as the courses are being laid. This is because during the manufacturing process of the blocks, they cannot all be manufactured to exactly the same height and the notches in the web may have crumbles of concrete in them which also stops the inserts from fitting properly. Therefore, erecting a wall takes much longer and any core inserts protruding from a block throws the wall off balance and have to be corrected before additional courses are laid on top, thus increasing the hours of labor to erect the wall. In addition, these inserts provide no structural strength to the wall.

According to some embodiments of the present invention, there is provided a dry stack construction block the internal connecting webs are not notched but reach all the way to the top of the block, providing additional structural strength.

According to some embodiments of the present invention, there is provided a dry stack construction block (U-block, for example colored black) having two parallel block walls which are connected by webs perpendicular to the block walls, wherein the connecting webs are U-shaped. The U blocks are placed in a course above several courses of regular types of blocks, and horizontal rebar(s) are put inside the U-blocks, for example two rebars. Each vertical rebar protruding through the cells may be tied together with the horizontal rebar, for example using a zip tie (for speed) or wire. This U-block is then filled with grout to create a horizontal bonding beam, in addition to the vertical rebar(s) in the wall system. Thus, the wall becomes a honeycomb of vertical and horizontal grouted rebar all situated within the blocks. The U-shaped bond beams are strategically placed by the structural engineer to add to the structural integrity of the system, for example in geographical areas that are prone to hurricanes, tornadoes and/or earthquakes. This U-block beam is also used to level any irregularities in the wall as it is built and re-level the wall.

As no mortar is used between the courses of blocks to level each course (as in a normal concrete masonry unit (CMU) system), the wall must be leveled at least every seventh course (or more, as designed by the structural engineer due to the geographical area, to add additional horizontal rebar). This is done by carefully leveling the wall as each U-block is laid using a spirit level, for example by placing grout or wall wedge shims under each U-block, so the U-blocks are perfectly leveled both horizontally and at 90 degrees across the U-block to the previous U-blocks already laid.

This also helps with accommodating manufacturing variations in the dimensions and density of the cells. All concrete block heights vary by a fraction of an inch as the blocks are hydraulically compressed during the manufacturing process and not all compressions are exactly the same, thus the height of each block may vary as much as one eighth of an inch.

According to some embodiments of the present invention, liquid closed cell foam is injected into the wall on site after the blocks have been erected and the grout poured into the vertical rebar, but before the U-block has been placed, filling all remaining air space within the wall structure that is not containing grout. This bonds the dry stacked blocks together as the foam expands and fills every cavity and adds significantly to the wall's structural strength, insulation value and sound proofing, dependent on the type of liquid foam used. Alternatively, holes may be drilled strategically in at the bottom of the block walls to fill the cells up to the next U-block course. This eliminates the need of foam inserts and the problems that are created for the inserts because of the inability to manufacture precise block heights. The closed cell foam also bonds the wall together adding additional structural strength to the wall, which the previously presented inserts do not do.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1B:
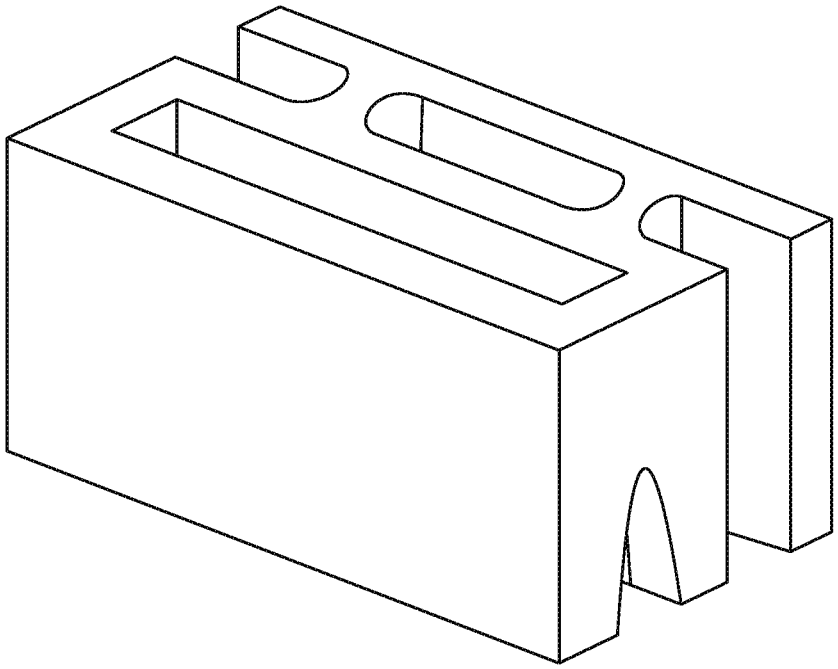
Figure 2A:
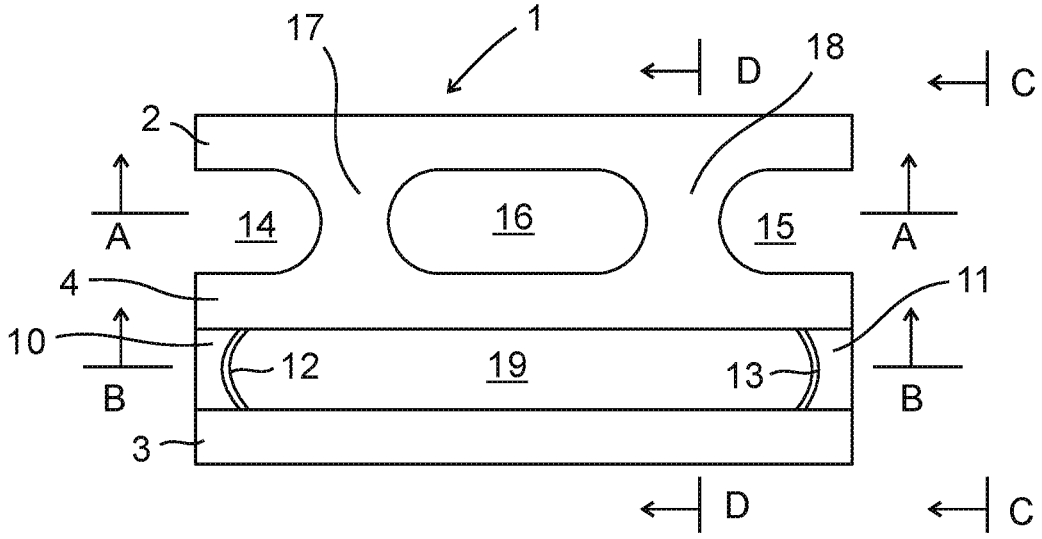
FIGS. 2A and 2B are top and bottom views of the dry stack construction block of FIG. 1A, respectively, according to some embodiments of the present invention.
Figure 2B:
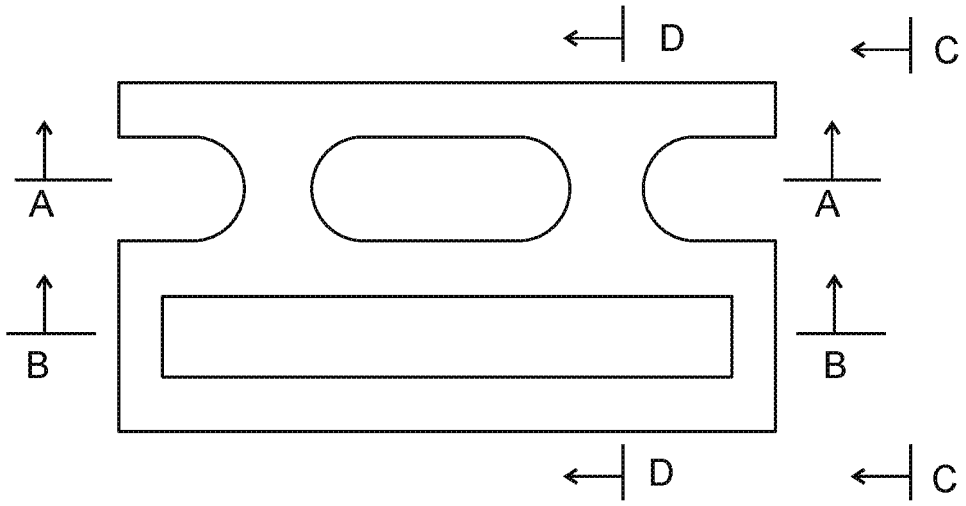
Figure 3A:
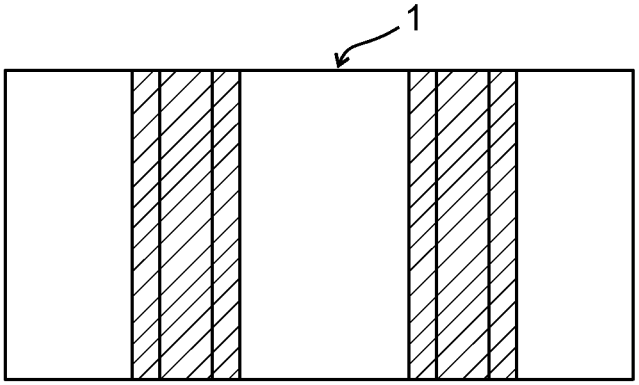
FIGS. 3A and 3B are cross-sectional views along lines A-A and B-B, respectively, of the dry stack construction block according to FIG. 2A.
Figure 3B:
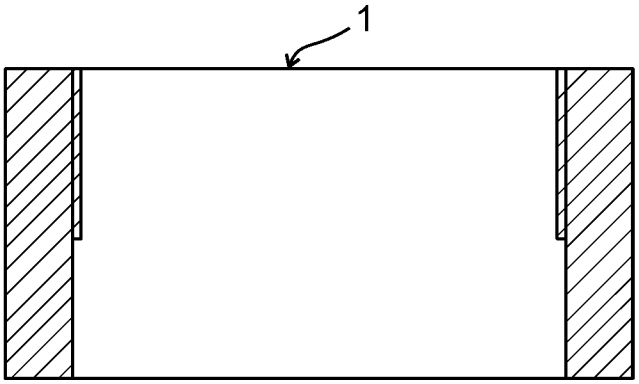
Figure 4A:
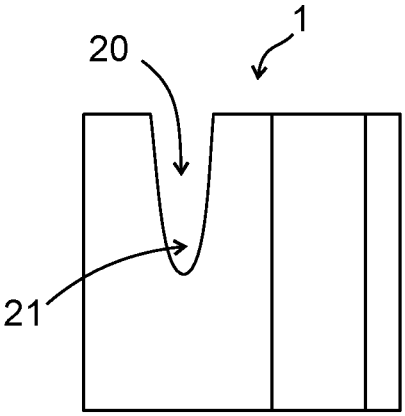
FIG. 4A and 4B are cross-sectional side views along lines C-C and D-D, respectively, of the dry stack construction block according to FIG. 2A.
Figure 4B:
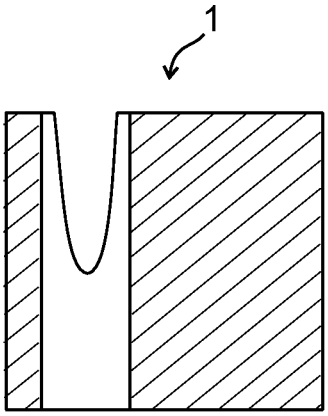

Referring now to the drawings, FIGS. 1A and 1B are top and bottom perspective views of an exemplary dry stack construction block, respectively, according to some embodiments of the present invention. Reference is also made to FIGS. 2A and 2B, which are top and bottom views of the dry stack construction block of FIG. 1A, respectively, according to some embodiments of the present invention. Reference is also made to FIG. 3A and FIG. 3B, which are cross-sectional views along lines A-A and B-B of the dry stack construction block according to FIG. 2A respectively, according to some embodiments of the present invention; and to FIG. 4A and FIG. 4B, which are cross-sectional side views along lines C-C and D-D of the dry stack construction block according to FIG. 2A respectively, according to some embodiments of the present invention.

Block 1 includes a first side wall 2 and a second side wall 3, and a central wall 4 interposed between first side wall 2 and second side wall 3. The walls are generally rectangular and generally parallel to one another and having generally the same block wall axial length 5 and wall height 6. Walls 2, 3 and 4 have a bottom edge located in a first plane, a top edge located in a second plane which is parallel to the first plane, a first end located in a third plane which is perpendicular to the first plane, and a second end located in a fourth plane which is parallel to the third plane.

First end transverse web 10 and second end transverse web 11 connect said first ends and said second ends respectively of said first side wall and said central wall in said third and fourth planes respectively, wherein said first and second end transverse webs have a bottom edge located in said first plane.

First side wall 2, central wall 4, first end transverse webs 10 and second end transverse webs 11 define the longitudinal bounds of a first cell 19. The interior surfaces 12 and 13 of end transverse webs 10 and 11, respectively, may be tapered. The height of transverse webs 10 and 11 is reduced, for example the height is slightly more than one-half the height of block 1. The height may be reduced by a V- or U-shaped notch or hyper-extended draw 20 which converges to a curvilinear notch bottom 21. The space between central wall 4 and second side wall 2 contains two open-ended third cells 14 and 15 separated by a central second cell 16. Intermediate transverse webs 17 and 18 each having full height are disposed at each end of second cell 16 and define the boundary between second cell 16 and third cells 14 and 15, respectively.

Block 1 may be, for example, 8 inches by 8 inches by 16 inches. The space between central wall 4 and second side wall 3 contain two open-ended cells running the full height of the block. Each of the open-ended cells may be, for example, approximately 3¼ inches long and 2⅜ inches wide. These are separated by a central second cell which may be, for example, approximately 6.5 inches long and 2⅜ inches wide running the full height of the block. It is recommends that the concrete mix used in manufacturing the blocks dries to at least 2,750 pound per square inch (PSI).

Figure 5:
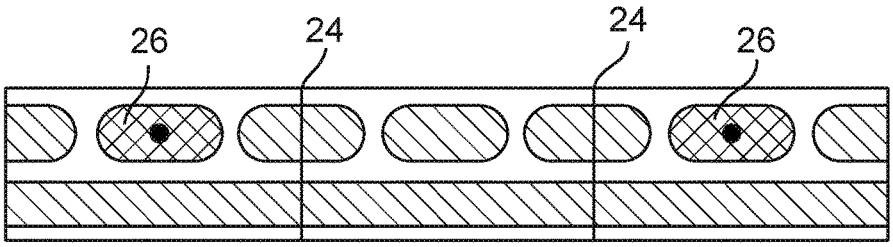
FIG. 5 is a cross-sectional top view of a block assembly comprising three abutting dry stack construction blocks next to each other in a row, according to some embodiments of the present invention.
Figure 6:
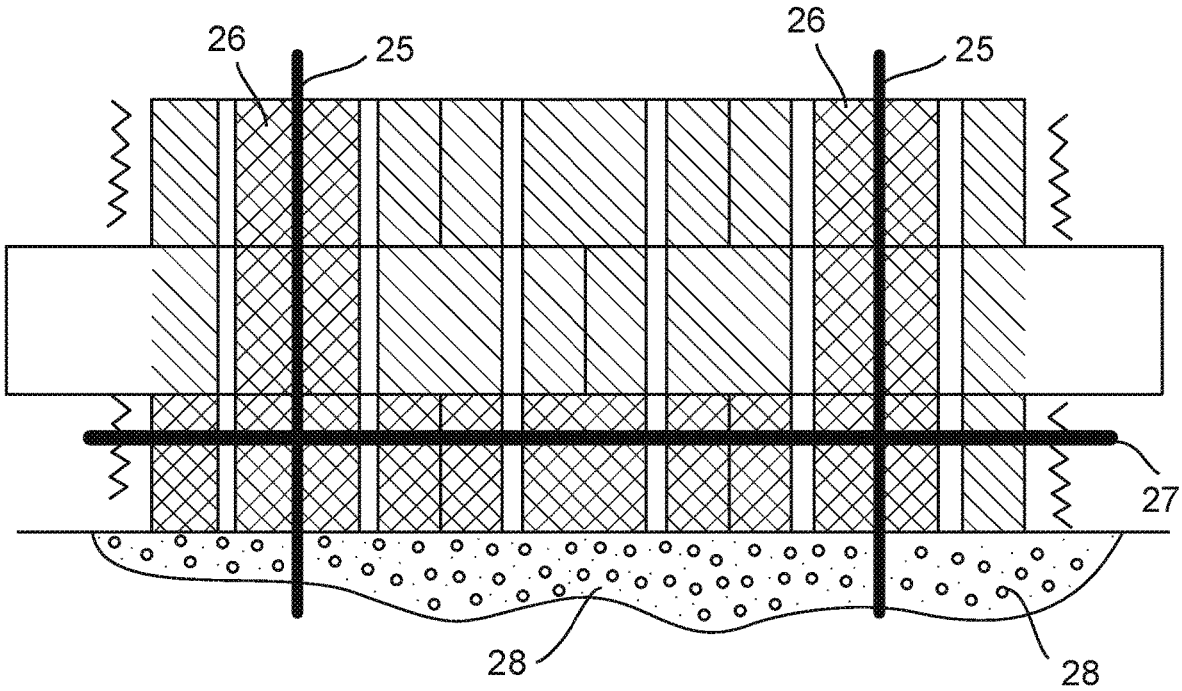
FIG. 6 is a cross-sectional view of a wall portion comprising a dry stack block assembly, according to some embodiments of the present invention.

Reference is now made to FIG. 5, which is a cross-sectional top view of a block assembly comprising three abutting dry stack construction blocks, according to some embodiments of the present invention. The exemplary assembly shown includes three dry stack construction blocks next to each other in a row. Reference is also made to FIG. 6, which is a cross-sectional view of a wall portion comprising a dry stack block assembly, according to some embodiments of the present invention. The figure shows the bottom course of blocks on the slab and the position of vertical and horizontal rebars, as designed by the structural engineer.

The latitudinal tubular space of the block is provided with grout 26 (marked by "####") and a vertical reinforcing bar(s) ("rebar") 25, and other spaces are provided with foam (marked by "/////"). Optionally, cells that are not filed with rebar and grout are injected with a liquid insulating material, for example closed cell foam such as polyurethane Class1 rated, thereby reducing the rate of thermal conduction through the resultant block wall. Rebars 25 may be placed, for example, vertically 32inches apart in the inside wall cell filled with grout 26. A bond beam may be created on the bottom course of blocks, for example at a vertical spacing of the standing wall, by laying one or more horizontally-extending reinforcing bars 27, and filling all the vertical spacing of the blocks with grout. The first running course of blocks 1 is laid on the foundation 28. Vertical rebars are anchored to foundation 28, before blocks are positioned on foundation 28. This may be done by drilling into foundation 28 and filling the hole with epoxy resin, and then inserting the vertical rebar into the hole.

Alternatively, holes may be drilled strategically in the outside wall 3 to fill cells 19 and wall 2 to fill cells 14, 15 and 16 or wall 29 to fill cells 39 and the smaller internal wall cells of the red corner blocks after the U-block has been positioned. This method is preferable when the liquid closed cell foam equipment is not readily available but should be filled as soon as possible, due to the structural strength the foam gives to the wall before continuing to build the wall above the U-block course. When this method is used, a bitumen membrane should be inserted under the U-block to prevent the foam from expanding into the U-block and to prevent the grout in the U-block from falling into the cells below, which are to contain the foam.

Figure 7:
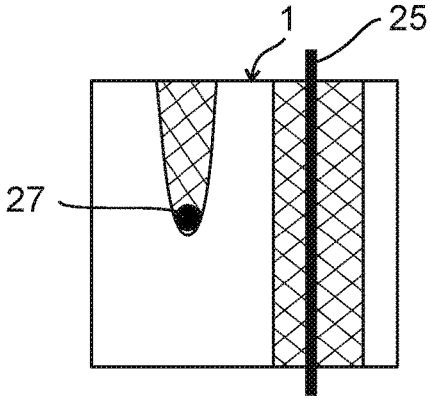
FIG. 7 is a vertical cross-sectional view of an exemplary dry stack construction block filled with grout, according to some embodiments of the present invention.

Reference is now made to FIG. 7, which is a vertical cross-sectional view of an exemplary dry stack construction block filled with grout, according to some embodiments of the present invention. Block 1 has a longitudinal niche with a horizontal rebar 27 placed in the curved notch bottom 21, and a latitudinal space with a vertical rebar 25.

Optionally, a set of several types of blocks are used to build a block wall. Optionally, each type of block is color coded so it is easy to see which type of block is used in the construction of the wall, to prevent the wrong type of block being used in the wrong position. This also enables unskilled labor to be used in the construction of the walls, for example with only one supervisor in charge of several crews or buildings, building multiple walls or structures. For example, dry stack block is naturally colored gray, being the color of the concrete mix. For example, U blocks are colored black, and right or left corner blocks and the half window or door blocks are colored red. This creates a "Lego" look which enables the skilled supervisor to see at a glance whether the correct block has been used in the correct position by the unskilled laborer and thus saves time in correcting any errors. When all the blocks are of the grey "natural" color, then it is very difficult to spot an error as in the previously presented dry stack construction blocks.

Figure 8A:
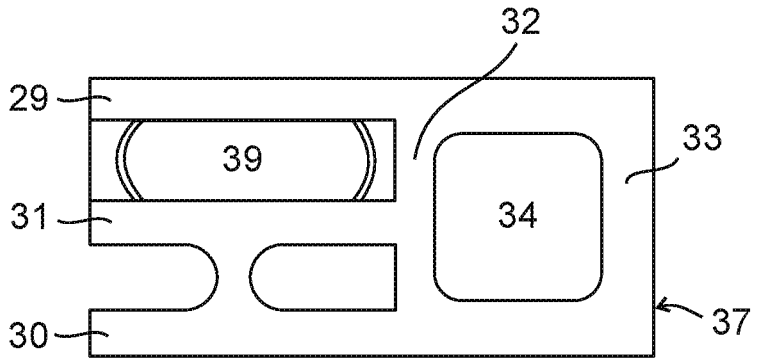
FIGS. 8A and 8B are top views of a right and a left corner block, respectively, according to some embodiments of the present invention.
Figure 8B:
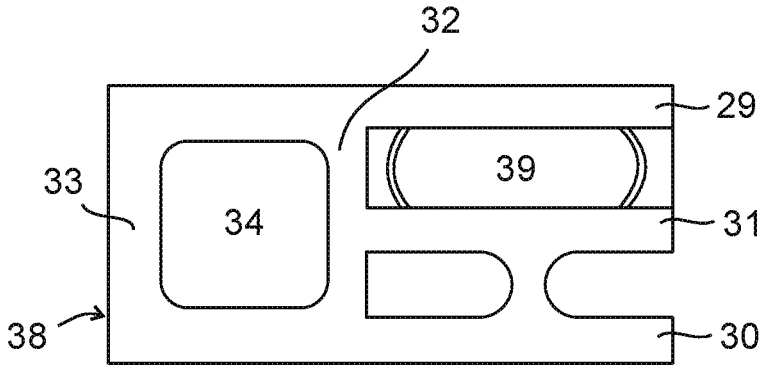

Reference is now made to FIGS. 8A and 8B, which are top views of a right and a left corner block 37 and 38, respectively, according to some embodiments of the present invention.

A corner block may be used where a wall is staggered and comes to an end to join another wall or where there is a window or door opening. Either a right angle corner block or left angle a corner block is used. Half of the length of the block (for example 8 inches) is designed the same way as the block 1 and the second half of the length of the block is designed as a hollow square with side walls 32 and 33. The side walls of hollow square the may be, for example, about one and a half inches thick. Each of corner blocks 37 and 38 comprises a first side wall 29 and a second side wall 30 and a central wall 31 disposed between walls 29 and 30, and extending approximately one-half the corner block wall axial length of the walls 29 and 30 to a transverse wall 32 extending between walls 29 and 30 and used with the side walls smooth end wall 33 to define a full size grout cell 34. Grout cell 34 may carry vertical rebar and grout to become a vertical bonding column.

Corner blocks 37 and/or 38 may be, for example, 8 inches by 8 inches by 16 inches and may be colored red. The space between the central wall 31 and the second side wall 30 contain two smaller cells, one closed and the other open with the open cell being of the same size and dimensions as the two open cells at either end of the block 1 (for example approximately 3¼ inches long by 2⅜ inches wide) so that this half-cell is the same size as the middle cell of block when it adjoins the half-cell of block 1 1 (for example approximately 6.5 inches by 2/3/8 inches). The space between the central wall 31 and the first side wall 29 creates cell 39. The space between the first side wall 29 and the second side wall 30 creates cell 34.

Figure 9:
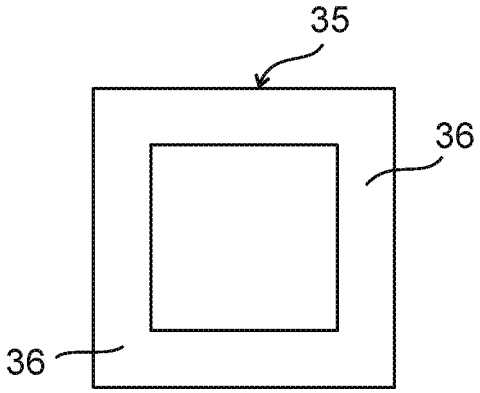
FIG. 9 is a top view of a corner half-block, according to some embodiments of the present invention.

Reference is now made to FIG. 9, which is a top view of a half-block, according to some embodiments of the present invention. Half-block 35 is a cube and comprises a standard wall 36, having a hollow middle. Half-block 35 may be, for example, 8 inches by 8 inches by 8 inches and may be colored red. These blocks are manufactured as a hollow square cube. The half-blocks are used as a filler block in conjunction with corner blocks 37 and 38 for example around windows and doors.

Figure 10A:
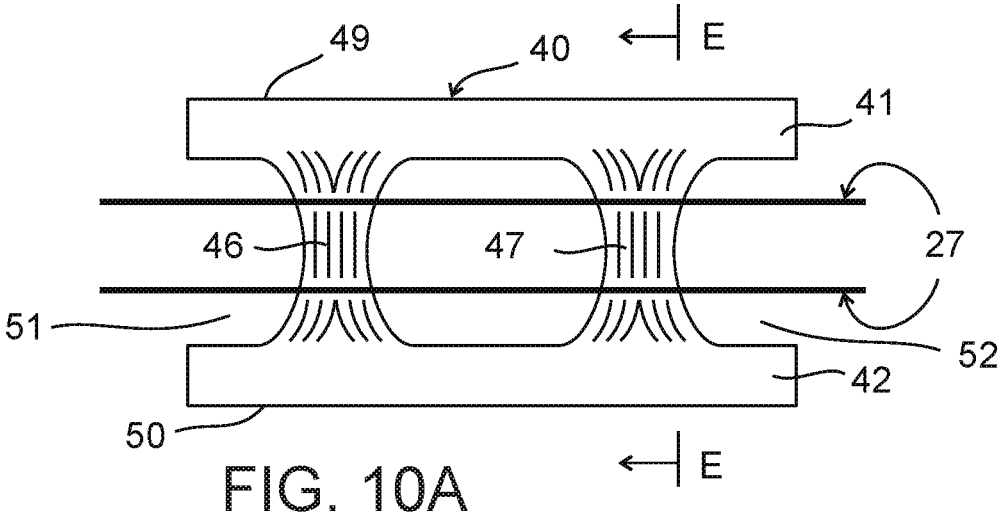
FIGS. 10A and 10B are top and bottom views, respectively, of a dry stack U block having a central cell and opposing end cells with rebar inserted but no grout inserted, according to some embodiments of the present invention.
Figure 10B:
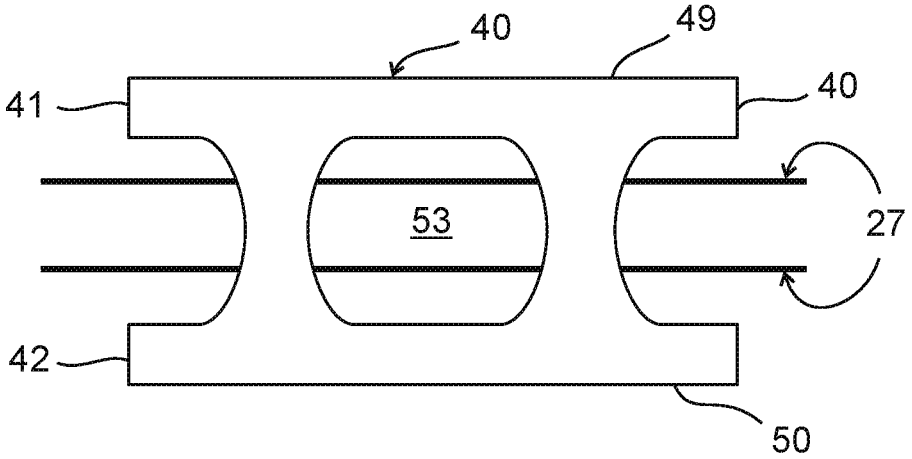
Figure 11:
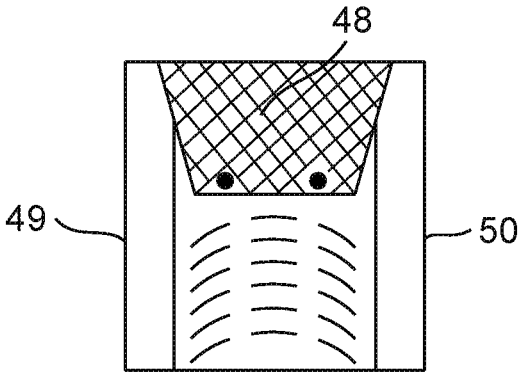
FIG. 11 is a section view along line E-E of the U block of FIG. 10A with rebars and grout inserted, according to some embodiments of the present invention.

Reference is now made to FIGS. 10A and 10B, which are top and bottom views, respectively, of a dry stack U block having a central cell and opposing end cells with rebar inserted but no grout inserted, according to some embodiments of the present invention. Reference is also made to FIG. 11, which is a section view along line E-E of the U block of FIG. 10A with rebars and grout 48 inserted, according to some embodiments of the present invention. U block 40 is designed to take both vertical and horizontal rebars and becomes a horizontal bonding beam. Where the vertical and horizontal rebar meet, they are joined together for example with a plastic tie or wire. U block 40 has first side wall 41 and second side wall 42 positioned on parallel surfaces 49 and 50 which are connected by two transverse block webs 46 and 47.

U block 40 consists of two open cells 51 and 52 and one closed cell 53. The outside wall thickness may be, for example, approximately 1.5 inches (similar in size and dimensions as to the walls of block 1, but where the two cells would meet at the center, the center wall may be, for example, approximately 2 inches thick rather than 3 inches). A U section runs along the top of the block (for example 3.5 inches deep) to contain the horizontal rebar(s) and the vertical rebar contained within the blocks 1 and/or blocks runs through the hollow chambers of the cube in U block 40.

Figure 12:
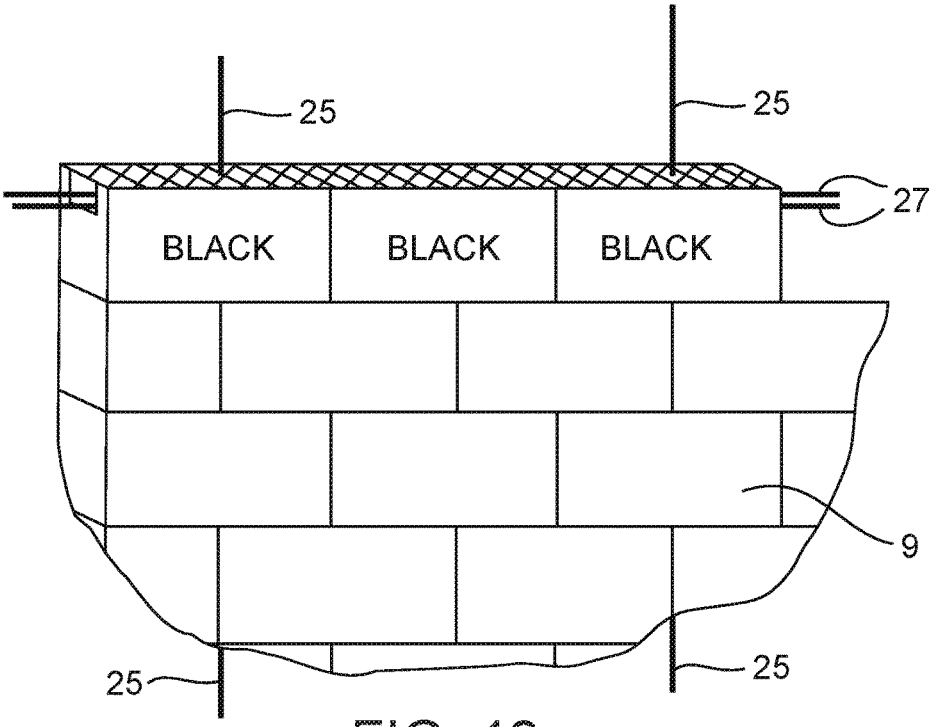
FIG. 12 is a perspective view of a wall portion comprising a dry stack block assembly, according to some embodiments of the present invention.

Reference is now made to FIG. 12, which is a perspective view of a wall portion comprising a dry stack block assembly, according to some embodiments of the present invention. The exemplary wall portion includes courses of dry stack block 1, and a top course of U blocks 40 filled with grout and includes vertical rebars 25. The rebars optionally protruding from the black block ready for the next vertical rebar to be tied into it and then ready for the next course of grey block. The U blocks 40 are used as the leveling course between courses of blocks 1 and corner blocks 37 and 38. Horizontal rebars 27 are positioned within the horizontal bonding beam made by U blocks 40. Cell 19 of block 1, and cell 39 of block 37 and block 38 should always face the outside of the wall. A horizontal rebar may be placed in a course of blocks 1 in cell 19 and blocks 37 and 38 in cell 39 or holes are drilled in blocks 35 to accommodate the insertion of horizontal rebar.

Figure 13:
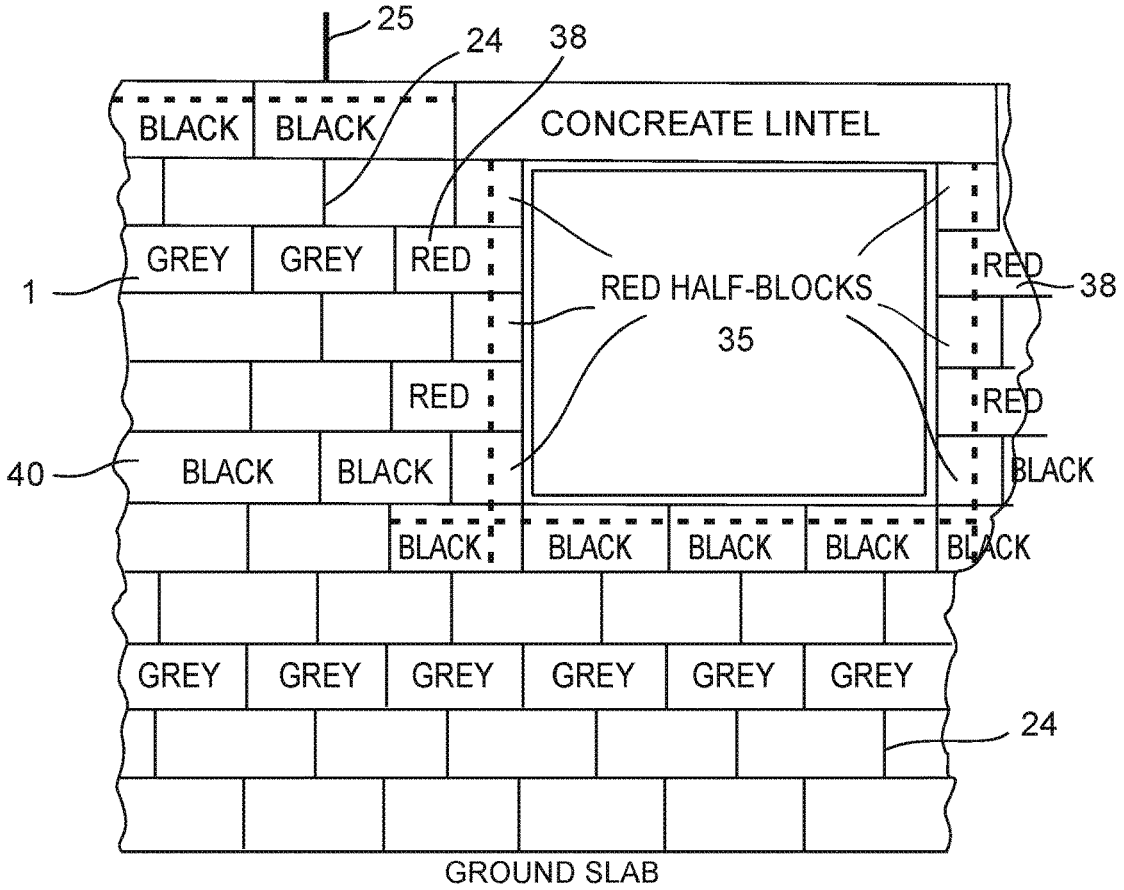
FIG. 13 is a side view of a window opening showing the positioning of rebars, grey block, red half-blocks, left corner red blocks, right corner red block and black U blocks together with a metal window surround, according to some embodiments of the present invention.

Reference is now made to FIG. 13, which is a side view of a window opening showing the positioning of rebars, grey block, red half-blocks, left corner red blocks, right corner red block and black U blocks together with a metal window surround, according to some embodiments of the present invention. A concrete lintel may also be used above the window.

Optionally, narrow blocks are used for non-load-bearing dry stack construction block wall. These narrow blocks may optionally colored blue. A set of narrow blocks of different types may be used to construct a non-load-bearing block wall.

Figure 14:
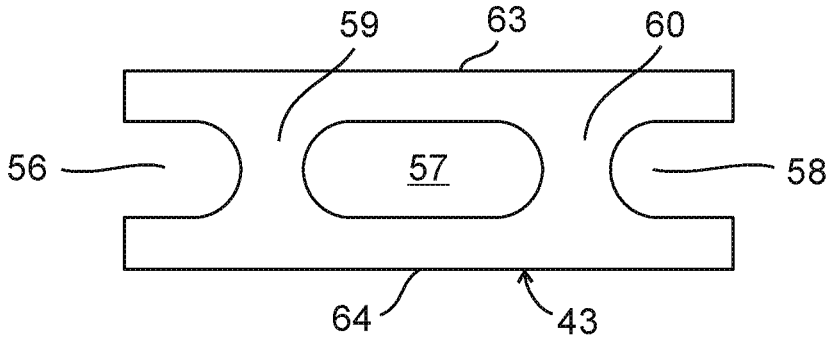
FIG. 14 is a top view of a narrow dry stack non-load-bearing internal wall block, having a central cell and opposing end cells, according to some embodiments of the present invention.

Reference is now made to FIG. 14, which is a top view of a narrow dry stack non-load-bearing internal wall block, having a central cell and opposing end cells, according to some embodiments of the present invention. Narrow block 43 comprises a first side wall and a second side wall positioned on a first planar surface 63 and a second planar surface 64, and connected by intermediate transverse webs 59 and 60.

The space between the first and the second side wall contain two open-ended cells 56 and 58 and a closed cell 57, running the full height of the block, in a similar way as in block 1. Narrow block 43 may be, for example, 8 inches by 5 inches by 16 inches. Blocks 43 may be arranged in running courses in a symmetrical staggered stack configuration or may be stacked in other configurations.

Figure 15A:
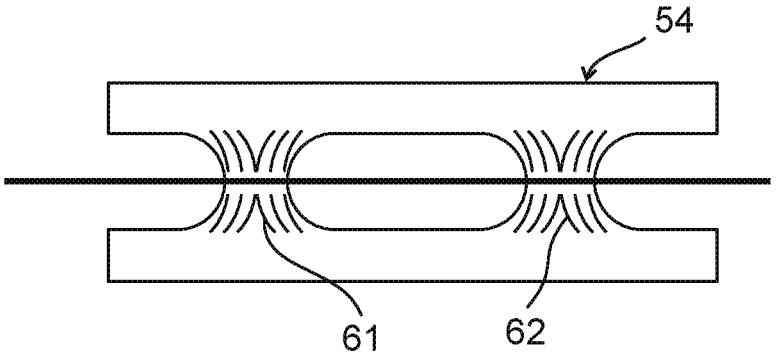
FIGS. 15A and 15B are top and a bottom views of a dry stack internal wall U block having a central cell and opposing end cells with rebar inserted but no grout inserted, according to some embodiments of the present invention.
Figure 15B:
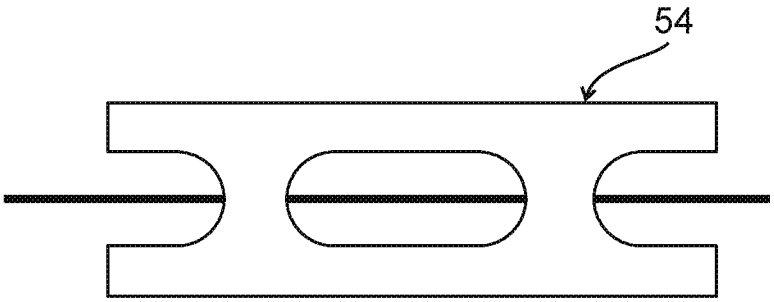
Figure 16:
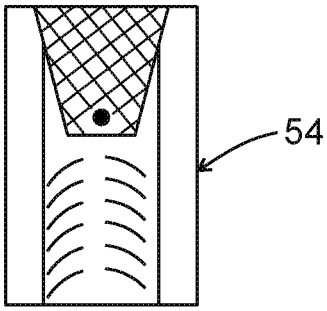
FIG. 16 is a section view of the narrow U block of FIG. 15A with rebar and grout inserted, according to some embodiments of the present invention.

Reference is now made to FIG. 15A and FIG. 15B, which are top and a bottom views of a dry stack internal wall U block having a central cell and opposing end cells with rebar inserted but no grout inserted, according to some embodiments of the present invention. Reference is also made to FIG. 16, which is a section view of the narrow U block of FIG. 15A with rebar and grout inserted, according to some embodiments of the present invention. Narrow U block 54 includes intermediate transverse webs 61 and 62, which are notched in order to include a horizontal rebar. Narrow U block 54 is designed to take both vertical and horizontal rebar and becomes the horizontal U bonding beam for the non-load-bearing internal wall, similar to U block 9. Narrow U block 54 may be, for example, 8 inches by 5 inches by 16 inches.

Narrow block 43 may be used on top of U block 40 if a T beam floor system is used at the second floor level as it will create a ledge for the T beams to drop into which when they are grouted together will support a T beam floor system. Alternatively a wood or rebar truss system may be employed on this ledge with the next course of block being the U block.

Figure 17:
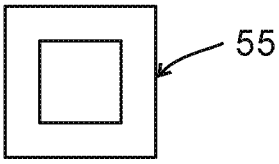
FIG. 17 is a top view of a narrow corner half-block, according to some embodiments of the present invention.

Reference is now made to FIG. 17, which is a top view of a narrow half-block, according to some embodiments of the present invention. Narrow half-block 55 may be used in the corners of non-load-bearing dry stack construction block wall, the same as half-block 35. Narrow half-block 55 may be for example, 5 inches by 5 inches by 16 inches.

Figure 18:
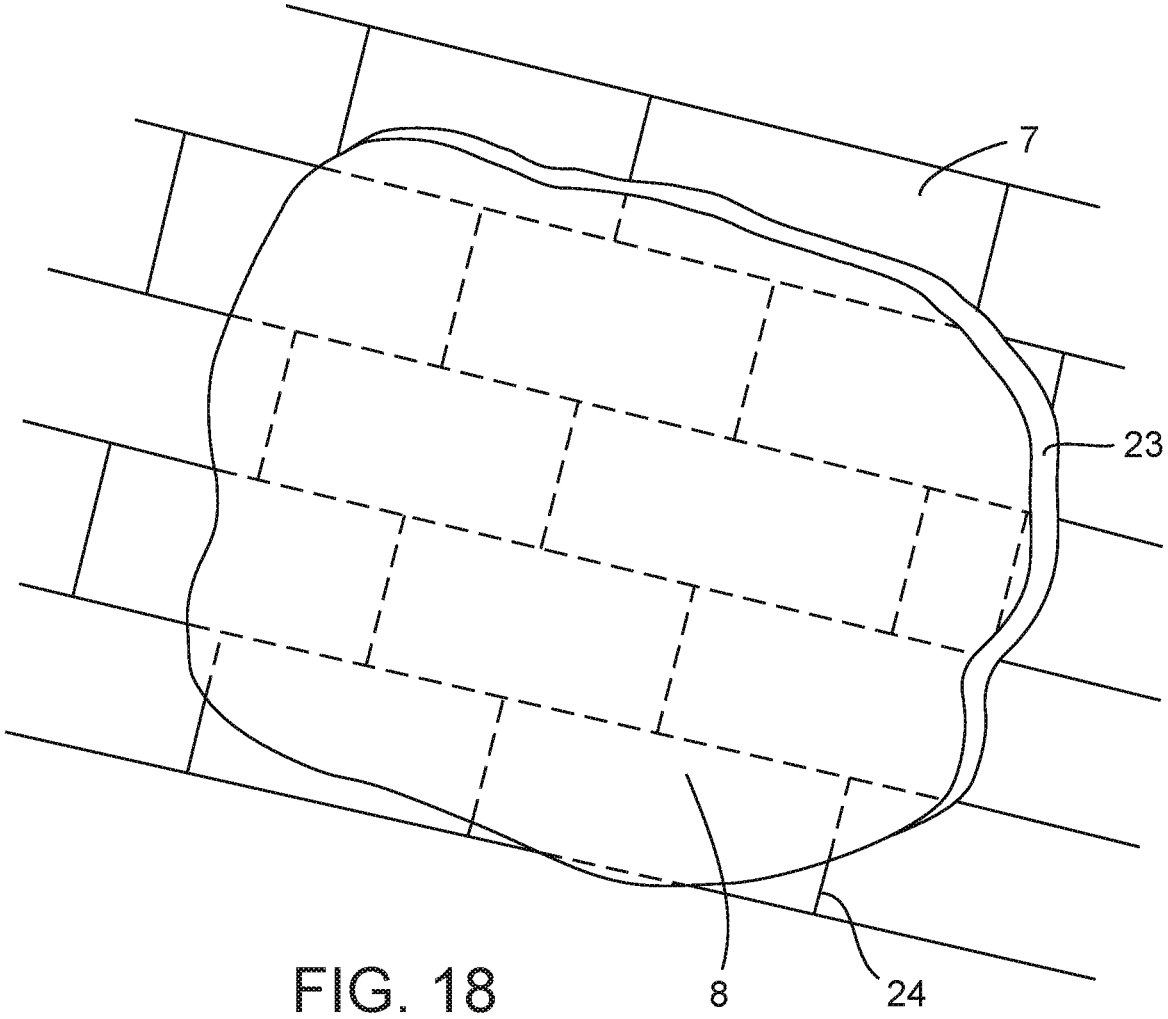
FIG. 18 is a perspective view of a portion of an internal or external part of a wall system with surface bond which is applied, according to some embodiments of the present invention.

Reference is now made to FIG. 18, which is a perspective view of a portion of an internal or external part of a wall system with surface bond which is applied, according to some embodiments of the present invention. This may represent either internal or external side of the wall because surfaced bonding is applied to both sides of the wall to add to the structural strength. It may be recommended to use a grout mix that dries to at least 5000 pound per square inch (PSI) and contains waterproofing materials, so the wall is impermeable to water. The dry stacked blocks employed in the erection of a standing wall should be coated with a surface bond 23 of surface bonding cement material which is inserted into block gaps 24 between blocks 1. This may provide a strong gapless interlock and enhance the shear strength and lateral strength of the standing wall.

Figure 19:
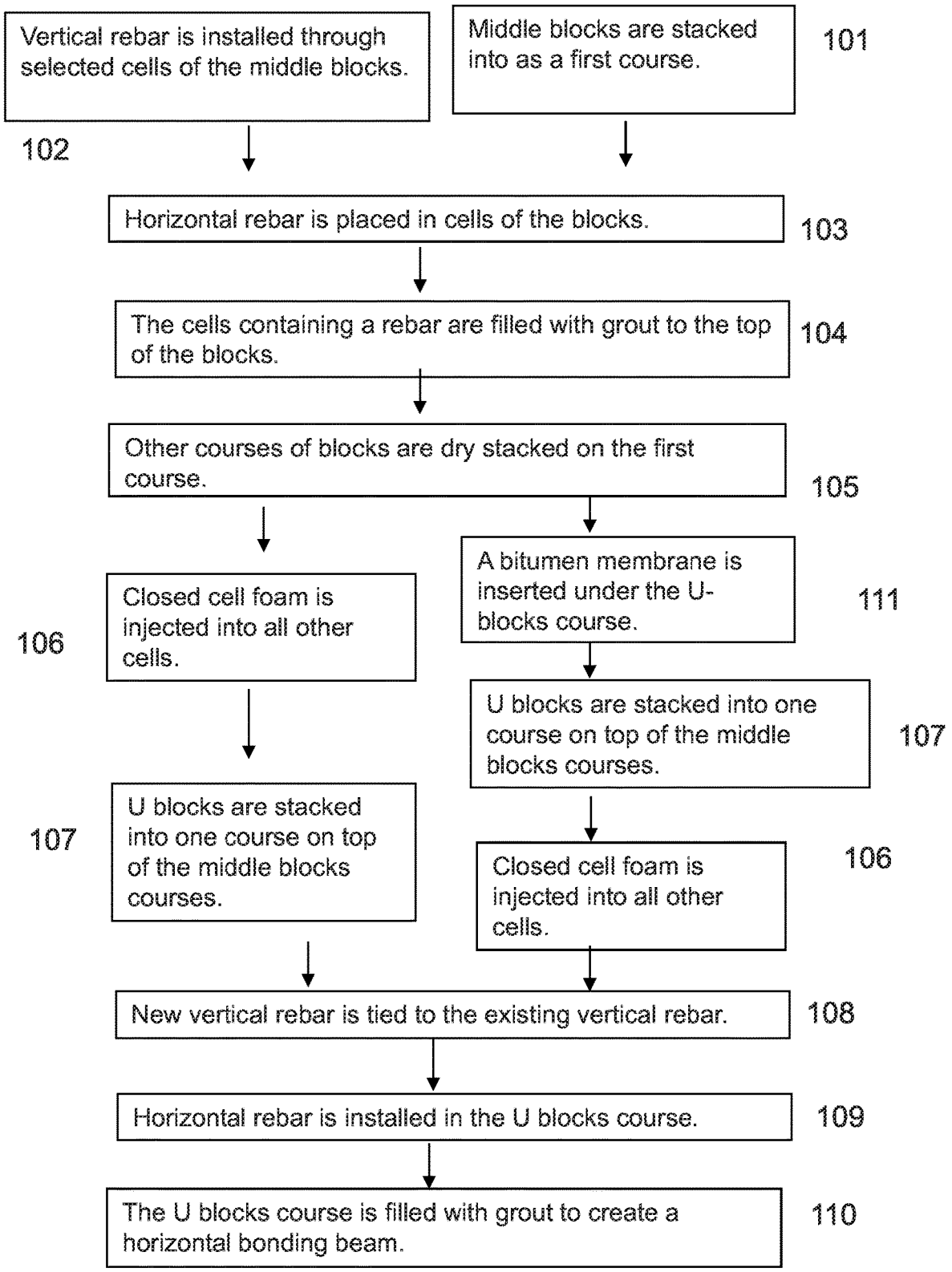
FIG. 19 is a flowchart schematically representing a method for erecting a dry stacked block wall, according to some embodiments of the present invention.

Reference is now made to FIG. 19, which is a flowchart schematically representing a method for erecting a dry stacked block wall, according to some embodiments of the present invention. A structural engineer may define where vertical rebars and horizontal rebars are to be placed which may also depend, for example, on local building codes or the geographical areas where the wall is built.

First, as shown at 101, a plurality of dry stack middle blocks (blocks 1) are laid as the first course, of for example, 6 courses. The base surface is leveled on the foundation. The blocks are, for example, manually lifted over the vertical rebars which is already positioned in the slab (as designed by the structural engineer). Corner blocks 37, 38 or half blocks 35 may be used at the ends of the wall or at wall openings as necessary.

Then, as shown at 102, vertical rebar(s) is installed through selected cells of the middle blocks (as designed by the structural engineer). Optionally or preferably, the vertical rebar(s) are put into the foundation before the blocks are placed so the blocks are lifted over it. This ensures the rebar is firmly in place in the slab.

Then, as shown at 103, horizontal rebar(s) is placed in cells 19 and/or 39 of the blocks, or a hole is drilled into the correct location if block 35 is used.

Then, as shown at 104, all cells containing a rebar are filled with grout to the top of the blocks. Attention should be made to remove any surplus grout from the top 17.

Then, as shown at 105, when the grout is set, at least one other course of blocks is dry stacked on the first course (to the height as designed by the structural engineer for example, 6 courses), by lifting each block over the vertical rebar. Then, the cells containing vertical rebar are filled with grout and vibrated to ensure no air bubbles remain in the grout.

Then, as shown at 106, closed cell foam is injected into all other cells of the middle blocks which are not filled with grout.

Then, as shown at 107, a plurality of dry stack U blocks are stacked into one course on top of the previous blocks courses and the wall is leveled as described above.

Alternatively, following the stacking of other courses of blocks 105, in step 107, U-blocks are stacked into one course on top of the middle blocks courses. At step 111, a bitumen membrane is inserted under the U-blocks course. Then, at step 106, closed cell foam is injected into all other cells.

Then, as shown at 108, new vertical rebar is tied using wire or zip ties to the existing vertical rebar protruding from the U-block. The process is repeated to the designed length and height of the next section of the wall. This should be done within the height of the U-block so when the grout is poured the wire/ties are covered with grout.

Then, as shown at 109, at least one horizontal rebar (for this example, two rebars) is installed in the U blocks course.

Finally, as shown at 110, The U blocks course is filled with grout to create a horizontal bonding beam. Vibration is used on the grout to remove all air pockets.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

It is expected that during the life of a patent maturing from this application many relevant construction blocks will be developed and the scope of the term construction block is intended to include all such new technologies a priori.

The terms "comprises", "comprising", "includes", "including", "having" and their conjugates mean "including but not limited to". This term encompasses the terms "consisting of" and "consisting essentially of".

The phrase "consisting essentially of" means that the composition or method may include additional ingredients and/or steps, but only if the additional ingredients and/or steps do not materially alter the basic and novel characteristics of the claimed composition or method.

As used herein, the singular form "a", "an" and "the" include plural references unless the context clearly dictates otherwise. For example, the term "a compound" or "at least one compound" may include a plurality of compounds, including mixtures thereof.

The word "exemplary" is used herein to mean "serving as an example, instance or illustration". Any embodiment described as "exemplary" is not necessarily to be construed as preferred or advantageous over other embodiments and/or to exclude the incorporation of features from other embodiments.

The word "optionally" is used herein to mean "is provided in some embodiments and not provided in other embodiments". Any particular embodiment of the invention may include a plurality of "optional" features unless such features conflict.

The term "rectangular" is used herein to mean "substantially rectangular", the term "parallel" is used herein to mean "substantially parallel", and the term "perpendicular" is used herein to mean "substantially perpendicular".

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A dry stack block structure, comprising: at least one course comprising a plurality of middle blocks, each of said middle blocks comprising:

a first side wall, a second side wall and a central wall positioned between and parallel to said first side wall and said second side wall, wherein said first, second and central walls are rectangular and having a bottom edge located in a first plane, a top edge located in a second plane which is parallel to said first plane, a first end located in a third plane which is perpendicular to said first plane, and a second end located in a fourth plane which is parallel to said third plane;

first and second end transverse webs connecting said first ends and said second ends respectively of said second side wall and said central wall in said third and fourth planes respectively, wherein said first and second end transverse webs have a bottom edge located in said first plane, and first and second intermediate transverse webs positioned between said third plane and said fourth plane and connecting said first side wall and said central wall, said intermediate transverse webs having a bottom edge located in said first plane and a top edge located in said second plane; such that the first side wall, the central wall, and the first and second intermediate transverse webs define boundaries of a central cell, the first side wall, the central wall, and the first intermediate transverse web define boundaries of a first outer half cell, and the first side wall, the central wall, and the second intermediate transverse web define boundaries of a second outer half cell;

and a course comprising a plurality of U blocks and positioned on top of said at least one course of middle blocks, each of said U blocks comprising:

a first U block side wall and a second U block side wall, wherein said first and second U block side walls are rectangular and have a bottom U block edge located in a first U block plane, a top U block edge located in a second U block plane which is parallel to said first U block plane, a first U block end located in a third U block plane which is perpendicular to said first U block plane, and a second U block end located in a fourth U block plane which is parallel to said third U block plane, and first and second U block intermediate transverse webs connecting said first U block side wall and said second U block side wall in planes situated between, and parallel to, said third and fourth U block planes respectively, such that the first U-block side wall, the second U-block side wall, and the first and second end U-block intermediate transverse webs define boundaries of a central U-block cell, the first U-block side wall, the second U-block side wall, and the first end U-block intermediate transverse web define boundaries of a first U-block outer half cell, and the first U-block side wall, the second U-block side wall, and the second end U-block intermediate transverse web define boundaries of a second U-block outer half cell;

wherein said U block intermediate transverse webs are U-shaped and have a bottom U block edge located in said first U block plane, and are vertically aligned with the first and second intermediate transverse webs, so that the central cells and the central U-block cells, and the first and second outer half cells and the first and second outer U-block half cells, are vertically aligned.

2. The dry stack block structure of claim 1, further comprising at least one reinforcing rebar extending horizontally through said transverse webs of said plurality of U blocks, said reinforcing rebars being grouted in place in said plurality of U blocks, thereby forming a grout beam.

3. The dry stack block structure of claim 1, further comprising a plurality of vertical reinforcing rebars extending through vertically aligned cells of said central cell and said first and second outer half cells of said plurality of middle blocks, said reinforcing rebars being grouted in place in said vertically aligned cells, thereby forming a plurality of grout columns.

4. The dry stack block structure of claim 3, further comprising a foundation, wherein said plurality of vertical reinforcing rebars are anchored to said foundation.

5. The dry stack block structure of claim 1, further comprising a plurality of reinforcing rebars extending through horizontally aligned cells of said plurality of middle blocks, said reinforcing rebars being grouted in place in said horizontally aligned cells, thereby forming a plurality of grout beams.

6. The dry stack block structure of claim 1, further comprising a surface bonding material applied on said first side wall and said second side wall.

7. The dry stack block structure of claim 3, wherein the vertical reinforcing rebars extend through vertically aligned cells of the central U-block cell and the first and second U-block outer half cells of the U-block course that is vertically aligned with said vertically aligned cells of the plurality of middle blocks.

8. The dry stack block structure of claim 7, wherein at least one of the vertically aligned cells of the plurality of middle blocks is bounded by a transverse web, central wall, and second wall of a first middle block of the plurality of middle blocks, and a transverse web, central wall, and second wall of an adjacent middle block of the plurality of middle blocks, and a vertically aligned cell of the U-block course is formed of a first U-block side wall, second U-block side wall, and U-block intermediate transverse web of a first U-block, and a first U-block side wall, second U-block side wall, and U-block intermediate transverse web of a second U-block of the plurality of U-blocks.

9. The dry stack block structure of claim 1, wherein the first and second intermediate transverse webs are positioned at a set distance from the third and fourth planes, respectively, and the first and second U-block intermediate transverse webs are positioned at the same set distance from the third and fourth U-block planes, respectively, so that the intermediate transverse webs and the U-block intermediate transverse webs are alignable when the U-block course is positioned atop said at least one course of middle blocks.

10. A method for erecting a dry stacked block wall, comprising:

stacking a plurality of dry stack middle blocks into at least two courses, each of said dry stack middle blocks comprising:

a first side wall, a second side wall and a central wall positioned between and parallel to said first side wall and said second side wall, wherein said first, second and central walls are rectangular and have a bottom edge located in a first plane, a top edge located in a second plane which is parallel to said first plane, a first end located in a third plane which is perpendicular to said first plane, and a second end located in a fourth plane which is parallel to said third plane;

first and second end transverse webs connecting said first ends and said second ends respectively of said second side wall and said central wall in said third and fourth planes respectively, wherein said first and second end transverse webs have a bottom edge located in said first plane; and first and second intermediate transverse webs positioned between said third plane and said fourth plane and connecting said first side wall and said central wall, said intermediate transverse webs having a bottom edge located in said first plane and a top edge located in said second plane, such that the first side wall, the central wall, and the first and second intermediate transverse webs define boundaries of a central cell, the first side wall, the central wall, and the first intermediate transverse web define boundaries of a first outer half cell, and the first side wall, the central wall, and the second intermediated transverse web define boundaries of a second outer half cell;

installing at least one vertical rebar through selected cells of said central cell, said first outer half cell, said second outer half cell of said plurality of dry stack middle blocks;

for each of said at least two courses, filling said selected cells with grout; for each of said at least two courses, injecting closed cell foam into all other non-selected cells of said central cell, said first outer half cell, said second outer half cell of said plurality of dry stack middle blocks;

stacking a plurality of dry stack U blocks into one course on top of said at least two courses, each of said dry stack U blocks comprising:

a first U block side wall and a second U block side wall, wherein said first and second U block side walls are rectangular and have a bottom U block edge located in a first U block plane, a top U block edge located in a second U block plane which is parallel to said first U block plane, a first U block end located in a third U block plane which is perpendicular to said first U block plane, and a second U block end located in a fourth U block plane which is parallel to said third U block plane;

first and second U block intermediate transverse webs connecting said first U block side wall and said second U block side wall in planes situated between, and parallel to, said third and fourth U block planes respectively, such that the first IJ-block side wall, the second U-block side wall, and the first and second end U-block transverse webs define boundaries of a central U-block cell, the first U-block side wall, the second U-block side wall, and the first end U-block transverse web define boundaries of a first U-block outer half cell, and the first U-block side wall, the second U-block side wall, and the second end U-block transverse web define boundaries of a second U-block outer half cell;

wherein said first and second U block intermediate transverse webs are U-shaped and have a bottom U block edge located in said first U block plane; and wherein the step of stacking a plurality of dry stack U blocks step comprises vertically aligning the first and second U block intermediate transverse webs with the first and second intermediate transverse webs, so that the central cells and the central U-block cells, and the outer half cells and the outer U-block half cells, are vertically aligned;

installing at least one horizontal rebar through said plurality of dry stack U blocks; and filling said one course of said dry stack U blocks with grout to create a horizontal bonding beam.

11. The method of claim 10, wherein the first and second intermediate transverse webs are positioned at a set distance from the third and fourth planes, respectively, and the first and second U-block intermediate transverse webs are positioned at the same set distance from the third and fourth U-block planes, respectively, and the method further comprises aligning the intermediate transverse webs of at least one course of the dry stack middle blocks and the U-block intermediate transverse webs when the plurality of dry stack U-blocks are positioned atop said at least two courses of middle blocks.

12. The method of claim 10, wherein the injecting step comprises drilling at least one hole in at least one of the two courses of the middle blocks, and injecting the closed cell foam through the at least one hole to fill the closed cell film into the all other non-selected cells of said central cell and said first and second outer half cells of said plurality of dry stack middle blocks and at least partially upward to the course of U-blocks.

13. The method of claim 12, wherein the injecting step is performed after the step of stacking a plurality of the dry stack U blocks into one course.

14. The method of claim 13, further comprising, prior to the injecting step, inserting a bitumen membrane under the U-block course, to prevent the foam from expanding into the U-block course.

* * * * *